US008844780B2

(12) United States Patent
Hunt

(10) Patent No.: US 8,844,780 B2
(45) Date of Patent: Sep. 30, 2014

(54) CONVERTIBLE STRAP

(75) Inventor: Darren Hunt, Overland Park, KS (US)

(73) Assignee: E & C Hunt Enterprises, LLC, Overland Park, KS (US)

( * ) Notice: Subject to any disclaimer, the term of this patent is extended or adjusted under 35 U.S.C. 154(b) by 207 days.

(21) Appl. No.: 13/408,789

(22) Filed: Feb. 29, 2012

(65) Prior Publication Data

US 2012/0223114 A1 Sep. 6, 2012

Related U.S. Application Data

(60) Provisional application No. 61/464,154, filed on Mar. 1, 2011.

(51) Int. Cl.
*A45F 3/14* (2006.01)
*A45C 13/30* (2006.01)

(52) U.S. Cl.
CPC .. *A45C 13/30* (2013.01); *A45F 3/14* (2013.01)
USPC ..... 224/609; 224/260

(58) Field of Classification Search
USPC ..... 224/600, 607, 608, 609, 610, 614, 616, 224/627, 153, 260, 268, 575, 577–579
See application file for complete search history.

(56) References Cited

U.S. PATENT DOCUMENTS 741,098 A * 10/1903 Bibler ..... 224/260
5,358,160 A * 10/1994 Bianchi ..... 224/244
5,695,101 A * 12/1997 Frietze ..... 224/250
7,857,181 B2 12/2010 Sacks

* cited by examiner

*Primary Examiner* — Adam Waggenspack
(74) *Attorney, Agent, or Firm* — Spencer Fane Britt & Browne LLP

(57) ABSTRACT

A strap for bearing the load of an object is disclosed. The strap includes a loop assembly rotatably attached to each end of a connector. Each loop assembly is a continuous loop of material, or two or more pieces of material joined together. The connector allows the strap to be placed on the shoulder of a user when transporting the object in a single-shoulder configuration. Each loop is connected to an object at a point opposite the elongated connector by an attachment having an aperture, thereby allowing the loop to move freely therethrough. The strap converts from a single-shoulder configuration to a dual-shoulder configuration, without needing to disconnect the strap from the object or removing the strap from the user, by the user extending an arm through each of the loops thereby transitioning the load of the object from the connector on one shoulder to a loop on each shoulder.

7 Claims, 6 Drawing Sheets

CONVERTIBLE STRAP

CROSS-REFERENCE TO RELATED APPLICATIONS

This application claims the benefit of U.S. Provisional Patent Application No. 61/464,154, filed Mar. 1, 2011, which is incorporated herein by reference in its entirety.

BACKGROUND OF THE INVENTION

This present disclosed subject matter relates generally to supports for transporting a load, more particularly, the technology relates to a convertible strap for carrying objects.

A load, such as an object or a luggage item, is typically transported by a person, either in contact with and supported by a surface such as the ground, or suspended above the surface. Suspension of the object is typically accomplished by use of strapping.

Strapping is either grasped by the user's hand, or is placed in contact with the user's body, such as the shoulders. Suspending a luggage item from the shoulder can provide ease of access to the contents however, prolonged suspension from a single shoulder can cause fatigue, and muscular-skeletal injuries such as neck pain, back pain, and deformed posture.

SUMMARY

A strap for bearing the load of an object is shown and described. In an embodiment, the strap includes two loops formed from the ends of the strap, where each end is pivotally connected adjacent a midpoint of the strap.

In another embodiment, the strap includes a first and second strap member connected to a primary strap. The primary strap extends between opposite ends, and the first and second strap members are each connected at one end to the primary strap at a pivot point adjacent a midpoint of the primary strap, and at the other end to one of the primary strap ends forming loops with the bottom face of the straps facing the center of the loop.

In another embodiment, the strap includes a connector extending between a first end and a second end, a first loop assembly pivotally connected to the connector first end forming a loop with the bottom face of the first loop facing the center of the loop, and a second loop assembly pivotally connected to the connector second end forming a loop with the bottom face of the second loop facing the center of the loop.

In another embodiment, the strap includes a connector extending between a first end and a second end. A first strap member first end is pivotally connected to the connector first end, and a second strap member first end is pivotally connected to the connector first end. Hardware connects the first strap member second end and second strap member second end forming a first loop where the bottom faces of the first and second strap members face the center of the loop. A third strap member first end is pivotally connected to the connector second end, and a fourth strap member first end is pivotally connected to the connector second end. Hardware connects the third strap member second end and fourth strap member second end forming a second loop where the bottom faces of the first and second strap members face the center of the loop. In another embodiment, the first and second strap members connect to the connector first end forming a Y-shaped connection, and the third and fourth strap members connect to the connector second end forming a Y-shaped connection.

Each loop may be provided with an attachment for connecting each loop to the object. An aperture in the attachment allows the loop to freely slide within the aperture. The hardware used with the first and second loops allows a user to adjust the size of the loops. The connector and loops may be provided with padding to aid in user comfort.

The various embodiments of the strap allow a user to transition between carrying the object in a single-shoulder and dual shoulder configuration without removing the strap from their body or disconnecting the strap from the object. In the single-shoulder configuration, the object is on a side of the user and load of the object is distributed by the portion of the strap between the pivot points, or the connector, to the user's shoulder. To transition to the dual-shoulder configuration, the user inserts their arm that is on the same side of the body as the object into the loop forming the forward loop and inserts their other arm into the loop forming the rearward loop. The loops enlarge as they are drawn across the shoulders, and the attachments freely slide along each loop allowing the loop to enlarge as the object is drawn rearward across the back of the user. In the dual-shoulder configuration, the object is located behind the user and the load of the object is distributed by the loops onto both shoulders. The bottom faces of the loops face the user.

These and other features, aspects and advantages of the present teachings will become better understood with reference to the following description, drawings, and appended claims.

DRAWINGS

The drawings constitute a part of this specification and include exemplary embodiments of the disclosed subject matter and illustrate various objects and features thereof. The drawings are not intended to limit the scope of the present teachings in any way.

DETAILED DESCRIPTION

Figure 1:
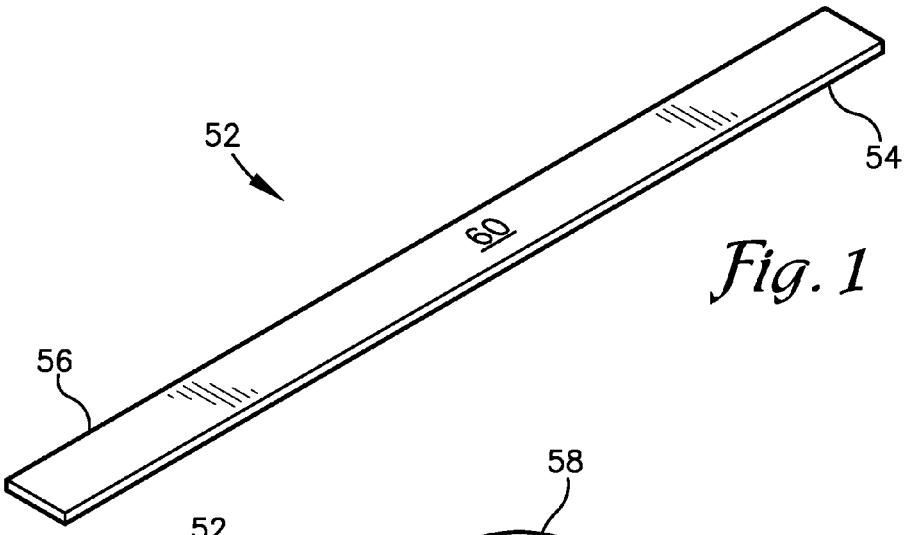
FIGS. 1-3 show an embodiment of a loop assembly embodying principles of the disclosed subject matter.

The disclosed subject matter includes a strap for bearing the load of an object. In an embodiment, the strap is a continuous loop of material, such as an oval, extending between a first end and a second end, with a middle portion there between. The oval is joined together at two points opposite the middle portion thereby forming a first loop at the first end and a second loop at the second end. The first loop may be attached to the object at a first attachment point by an attachment having an aperture through which the first loop may freely slide, and the second loop may be attached to the object at a second attachment point by an attachment having an aperture through which the second loop may freely slide.

In an embodiment, the strap is a single piece of elongated material having a top face and a bottom face, and extending between a first end and a second end from a midpoint. The first end is pivotally connected at a first pivot point adjacent the midpoint forming a first loop, and the top face of the first end faces the bottom face of the strap. The second end is pivotally connected at a second pivot point at a point adjacent the midpoint and opposite the first pivot point forming a second loop, and the top face of the second end faces the bottom face of the strap. The bottom faces of the straps forming the loops face the center of the loops. In an embodiment, the area of the strap between the first and second pivot points is reinforced with a resilient material forming a shoulder pad.

In an embodiment, the strap comprises two or more pieces of material. Referring to FIGS. 4-10, a strap 102 embodying principles of the disclosed subject matter for bearing the load of an object 152 is shown and described. The strap 102 includes a first loop assembly 120 and a second loop assembly 170, joined by a middle portion or connector 104. Each loop assembly 120 and 170 may be connected to the object 152 wherein the strap 102 is connected to the object 152 at two points.

Figure 2:
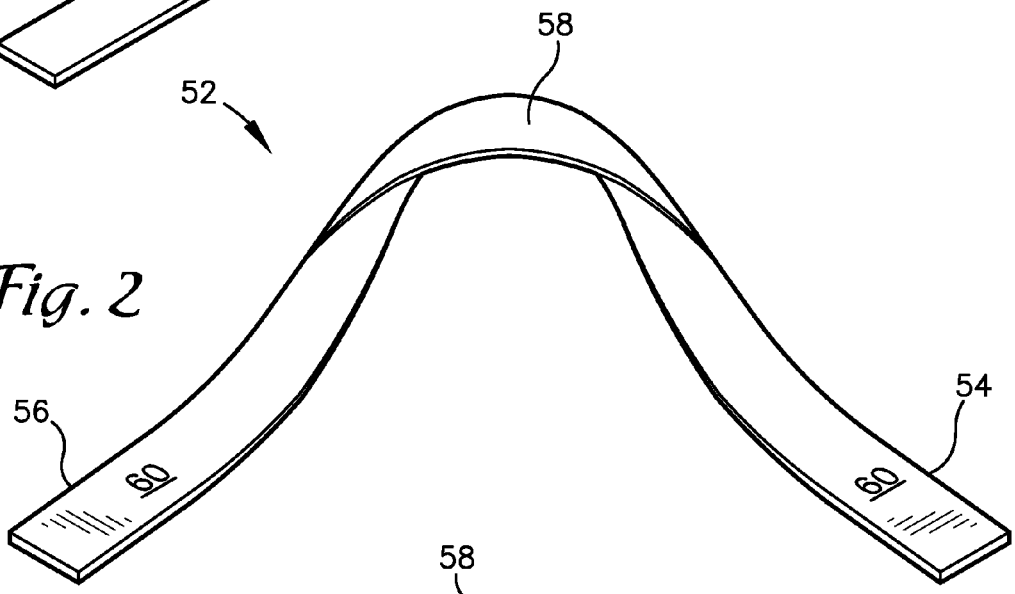
Figure 3:
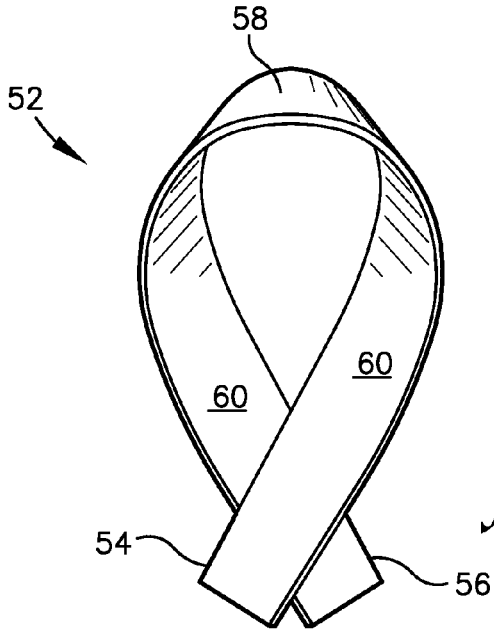

Turning to FIGS. 1-3, the following discussion of the strap 52 provides an explanation of the general geometric shape that forms the first loop assembly 120 and second loop assembly 170. In an embodiment, the aforementioned first loop assembly 120 generally takes the form of an elongated strap 52 extending between a first end 54 and a second end 56, and having a first surface 58 and an opposite second surface 60 (FIG. 1). To form the first loop assembly 120, the first end 54 is brought toward the second end 56 keeping the second surface 60 facing up (FIG. 2). Alternatively, formation of the loop is formed by rotating the first end 54 one hundred eighty degrees and bringing the first end 54 and second end 56 together forming a loop. The first surface 58 of the first end 54 overlaps the second surface 60 of the second end 56 (FIG. 3). The overlapping area creates a pivot point, discussed further below. The resulting first loop assembly 120 generally forms a circle with the first surface 60 facing the center of the circle.

To form the second loop assembly 170, the first end 54 is brought toward the second end 56 keeping the second surface 60 facing up. The second surface 58 of the second end 56 overlaps the first surface 60 of the first end 54 (not shown). The overlapping area creates a pivot point discussed further below. The resulting second loop assembly 170 generally forms a circle with the first surface facing the center of the circle.

As will be understood below, each loop assembly 120 and 170 may pivot about their attachment point relative to the connector 104 to generally form a circle.

The aforementioned strap 102 is convertible between a single-shoulder load bearing configuration (FIG. 4) and a dual-shoulder load bearing configuration (FIG. 5) allowing a person or user to transition between carrying the object 152 on a single-shoulder and on both shoulders without removing the strap 102 from their body or disconnecting the strap 102 from the object 152.

Referring to FIG. 1, the strap 102 is shown in the single-shoulder configuration supporting an object 152, wherein the object 152 is a piece of luggage 154, and the load of the object 152 is distributed by the connector 104 to the shoulder. The connector 104 extends between a first end 106 and a second end 110, and may be manufactured from a resilient material including a width of fabric, a nylon strap, wood, plastic, or metal. Although the strap 102 is shown connected to a piece of luggage 154, represented by a brief bag, the strap 102 may be used with any type of object capable of being carried by a user, including a reinforced container, including hard-sided luggage or sports equipment, and an un-reinforced container, including soft-sided luggage, and duffel bags. In an alternative embodiment, the first loop assembly 120 and second loop assembly 170 further includes a first attachment 148 and a second attachment 198, respectively, for connecting the strap 102 to an object 152. Each attachment 148 and 198 may further include a ring, ring and snap hook, or swivel loop.

Figure 10:
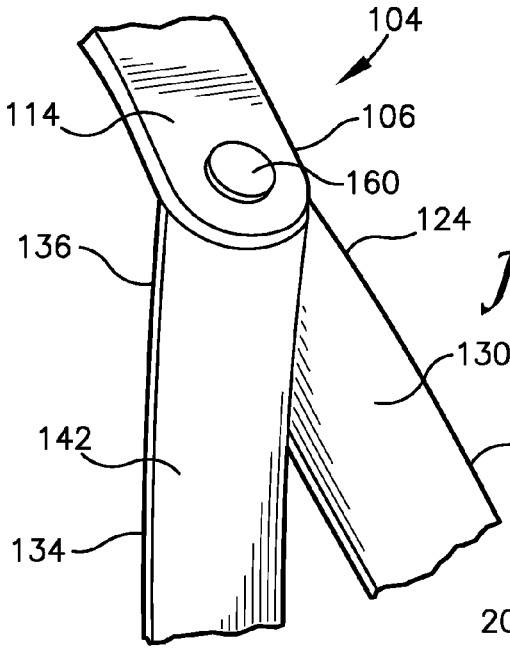
FIG. 10 is an enlarged perspective view of the connection between the connector and first loop assembly.

In an alternative embodiment, each of the first loop assembly 120 and second loop assembly 170 comprises two or more segments to allow adjustability of the loop assemblies. Accordingly, the first loop assembly 120 includes a first strap member 122 and a second strap member 134, with the first loop assembly 120 connected to the first end 106 of the connector 104 at a first attachment point 119. The first strap member 122 is a width of material, including a nylon strap, and extends between a first end 124 having an aperture, and a second end 128. The first strap member 122 further includes a top face 130 and a bottom face 132. The second strap member 134 is a width of material, including a nylon strap, and extends between a first end 136 having an aperture, and a second end 140. The second strap member 134 further includes a top face 142 and a bottom face 144. The first strap member 122 is connected to the second strap member 134 by a first hardware including a hook and loop fastener, buckle, a cam buckle, a side release buckle, and a tension buckle. In an embodiment, the first hardware includes a buckle 129 connected to the first strap member 122 second end 128. The second strap member 134 second end 140 is threaded through the buckle 129, and creates a loop 147 in the first loop assembly 120 opposite the connector 104. The bottom face 144 of the second strap member 134 first end 136 overlaps the top face 130 of the first strap member 122 first end 124 so that the apertures align. The first ends 136 and 124 are pivotally connected to the first end 106 of the connector 104 by a fastener 160 including a rivet that passes through the apertures, thereby allowing the first loop assembly 120 to transition into a right shoulder strap generally in the form of a circle when the strap 102 transitions from the single-shoulder configuration to a dual-shoulder configuration, described more fully below. FIG. 10 is an enlarged view of the first strap member 122 and second strap member 134 connected to the first end 106 of the connector 104.

The second loop assembly 170 includes a third strap member 172 and fourth strap member 184, with the second loop assembly 170 connected to the second end 110 of the connector 104 at a first attachment point 169. The third strap member 172 is a width of material, including a nylon strap, and extends between a first end 174 having an aperture, and a second end 178. The third strap member 172 further includes a top face 180 and a bottom face 182. The fourth strap member 184 is a width of material, including a nylon strap, and extends between a first end 186 having an aperture, and a second end 190. The third strap member 172 is connected to the fourth strap member 184 by a second hardware including a hook and loop fastener, a buckle, a cam buckle, a side release buckle, and a tension buckle. In an embodiment, the second hardware includes a buckle 179 connected to the third strap member 172 second end 178. The fourth strap member 184 second end 190 is threaded through the buckle 179, and creates a loop 197 in the second loop assembly 170 opposite the connector 104. The bottom face 194 of the first end 186 of the fourth strap member 184 overlaps the top face 180 of the first end 174 of the third strap member 172 so that the apertures align. The first ends 186 and 174 are pivotally connected to the second end 110 of the connector 104 by a fastener 162 including a rivet that passes through the apertures, thereby allowing the second loop assembly 170 to transition into a left shoulder strap in the form generally of a circle as the strap 102 transitions from the single-shoulder configuration to a dual-shoulder configuration, described more fully below.

In an alternative embodiment, the first loop assembly 120 is formed by overlapping the bottom face 132 of the of the first strap member 122 first end 124 over the top face 142 of the second strap member 134 first end 136, and the second loop assembly 170 is formed by overlapping the bottom face 182 of the third strap member 172 first end 174 over the top face 192 of the fourth strap member 184 first end 186.

Figure 5:
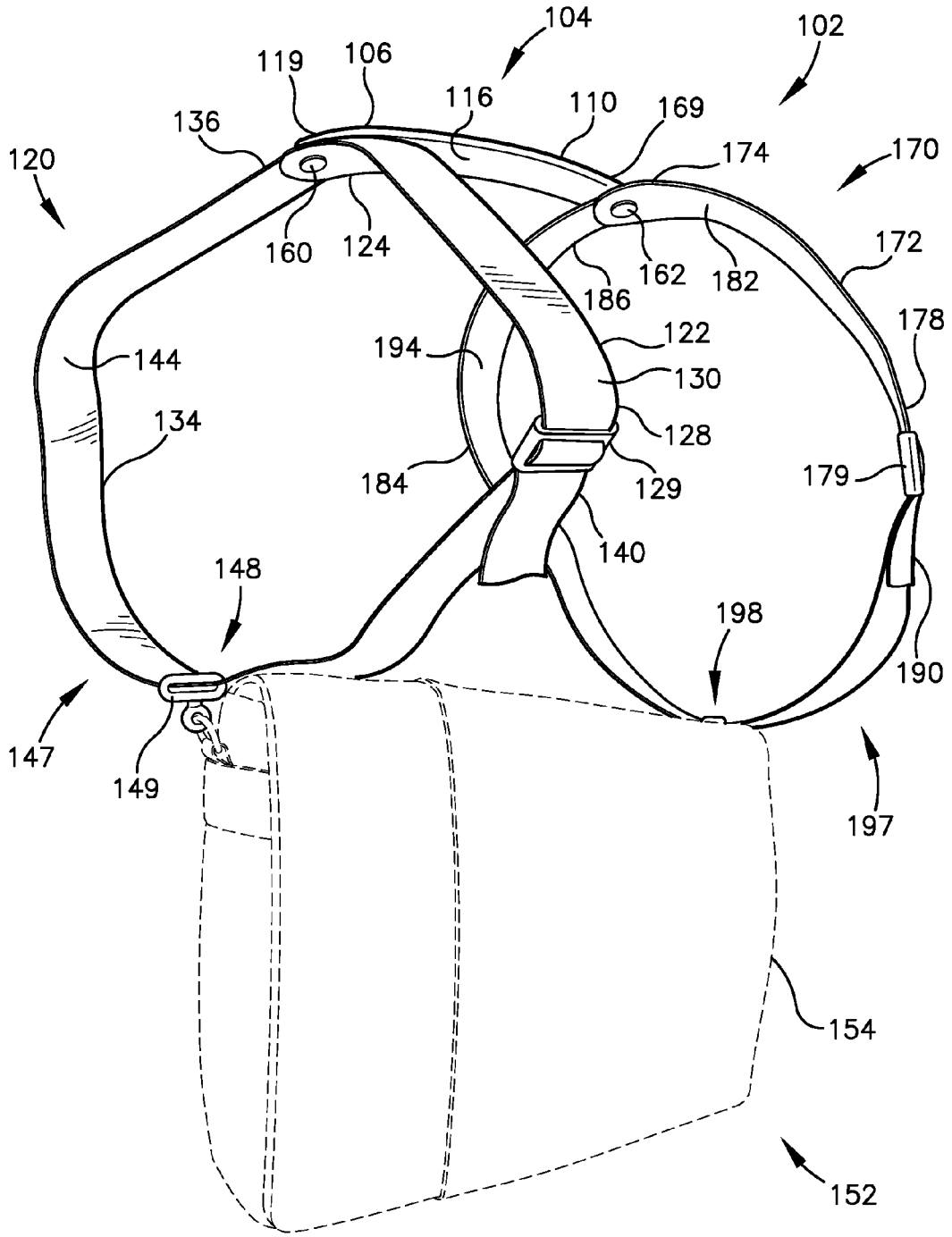
FIG. 5 is a perspective view of a strap embodying principles of the disclosed subject matter supporting an object in a dual-shoulder load bearing configuration.

Referring to FIG. 5, the strap 102 is shown in the dual-shoulder load bearing configuration with the first loop assembly 120 generally forming a circle, and the second loop assembly 170 generally forming a circle.

Figure 4:
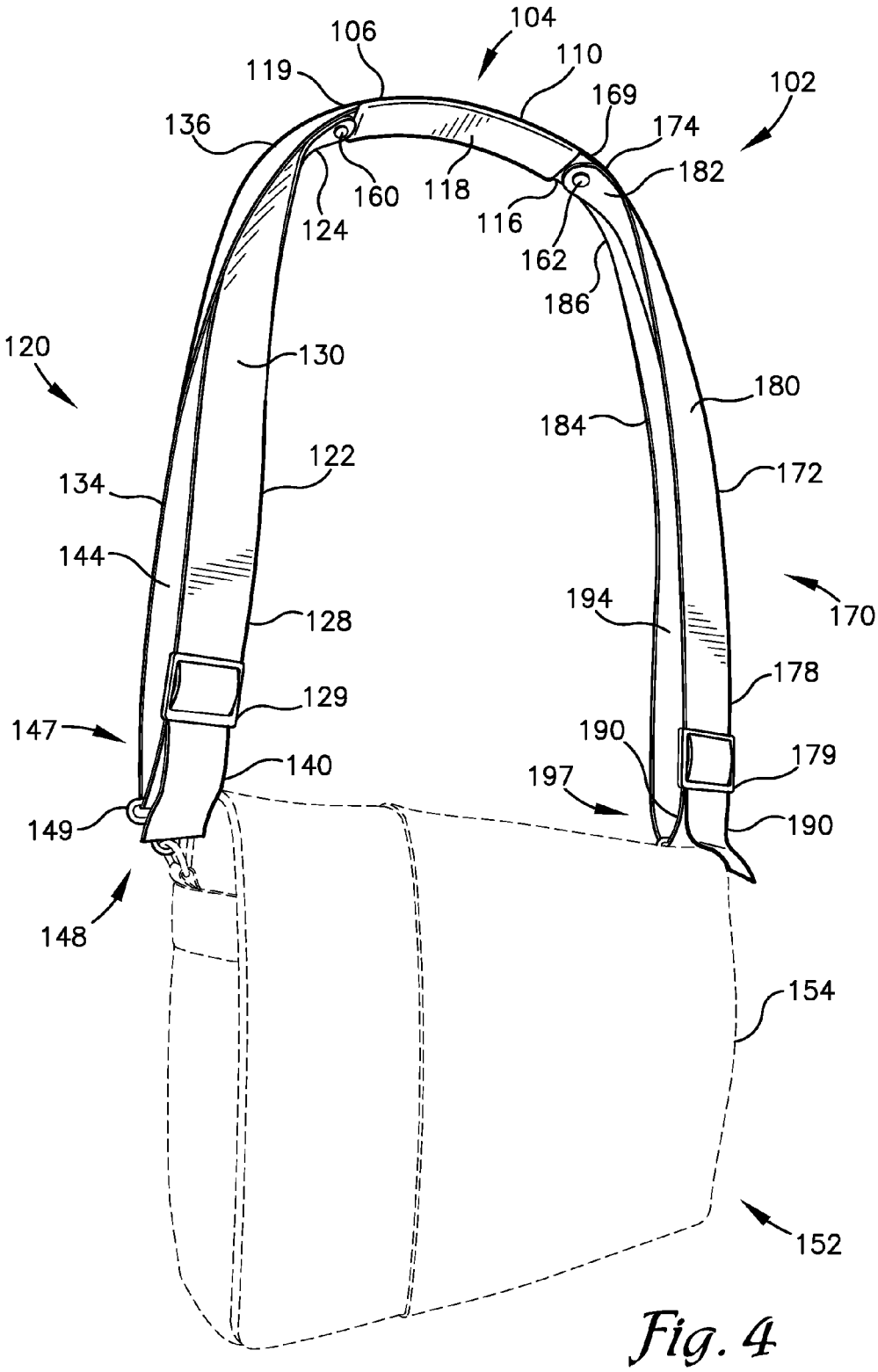
FIG. 4 is a perspective view of a strap embodying principles of the disclosed subject matter supporting an object in a single-shoulder load bearing configuration.
Figure 6:
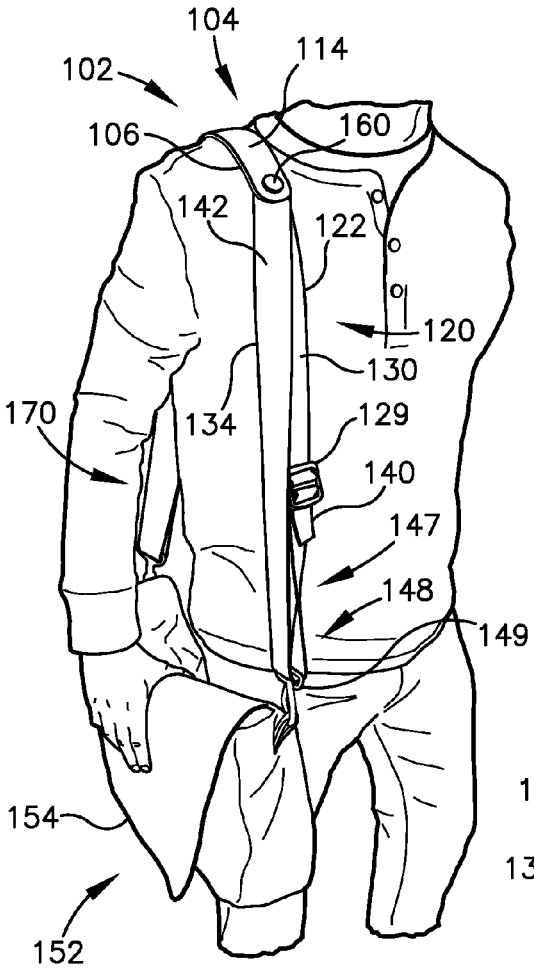
FIGS. 6-9 show a perspective view of the strap transitioning from a single-shoulder load bearing configuration to a dual-shoulder load bearing configuration.
Figure 7:
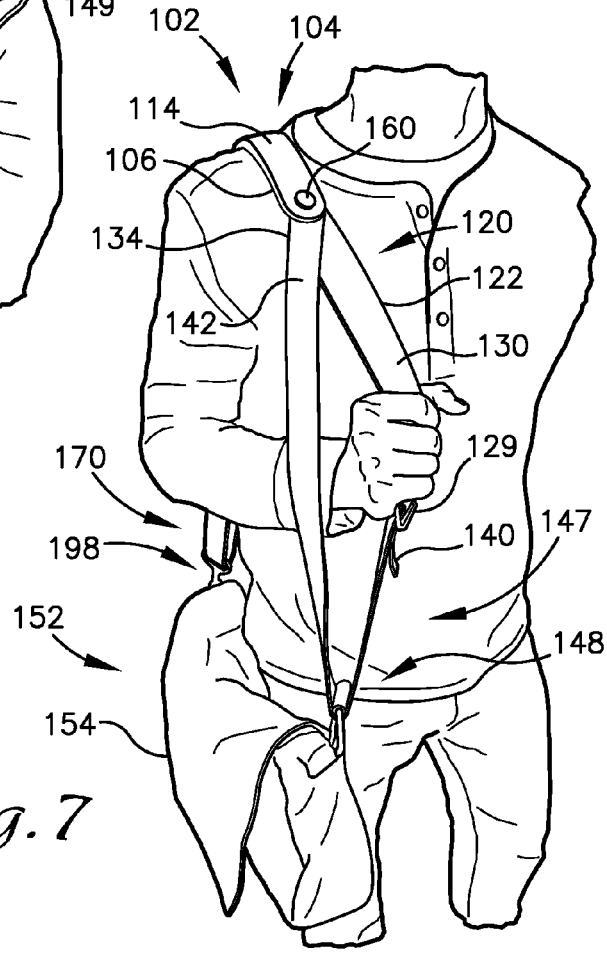
Figure 8:
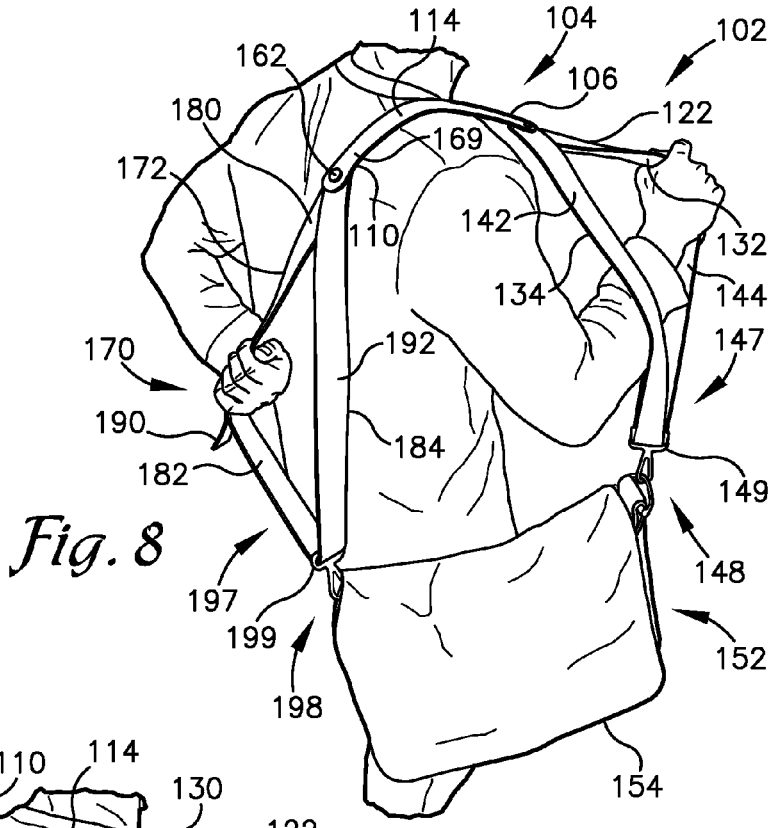
Figure 9:
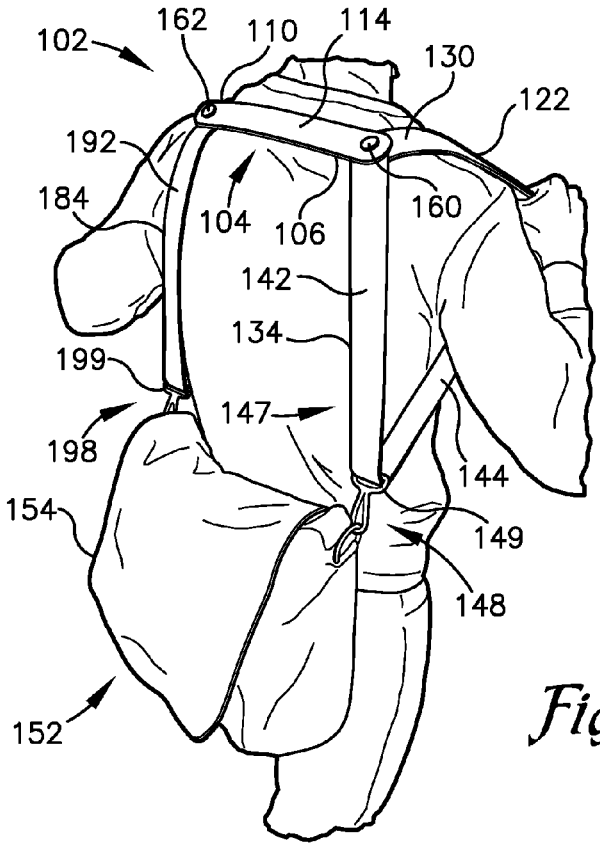

Referring to FIGS. 6-9, the strap 102 is shown transitioning from the single-shoulder configuration to a dual-shoulder configuration. The strap 102 is as shown in FIG. 4 above, wherein the object 152 is on the right side of the user, and the strap 102 is on the right shoulder of the user (FIG. 6). The user brings their right hand forward, away from the second loop assembly 170 and toward the first loop assembly 120, and inserts their hand into the loop 147 (FIG. 7). The user then grasps the first strap member 122 and pushes it forward, allowing the second strap member 134 to freely slide within the aperture 149 of the first attachment 148 thereby enlarging the loop 147. The user then brings their left hand rearward, toward the second loop assembly 170, and inserts their hand into the loop 197 (FIG. 8). The user then grasps the third strap member 172 and pulls it to their left side, allowing the fourth strap member 184 to freely slide within the aperture 199 thereby enlarging the loop 197. As the second loop assembly 170 is brought around to the left side of the user, the first strap member 122 and second strap member 134 rotate about the fastener 160, the third strap member 172 and fourth strap member 184 rotate about the fastener 162, and the connector 104 is drawn rearward across the back of the user (FIG. 9). The strap 102 is now in a dual-shoulder configuration whereby the first strap member 122 forms the right shoulder strap and the third strap member 172 forms the left shoulder strap, both of which are joined by the connector 104. In the dual-shoulder configuration, the object 152 is supported behind the user. Accordingly, the bottom faces 132 and 182 of the first and third strap members 122 and 172, respectively, face the user, and the bottom faces 144 and 194 of the second and fourth strap members 134 and 184, respectively, face the user.

In the embodiment shown in FIG. 9, the second end 140 of the second strap member 134 may be drawn through the buckle 129 to adjust the size of the loop 147 and in turn, the distance between the object 152 and connector 104. In addition, the second end 190 of the fourth strap member 184 may be drawn through the buckle 179 to adjust the size of the loop 197 and in turn, the distance between the object 152 and connector 104.

In an alternative embodiment, the strap 102 may be provided with padding so it is more comfortable during use. For example: the bottom face 116 of the connector 104 may include padding 118 to make the strap 102 more comfortable when used in the single-shoulder configuration (FIGS. 4 and 6); and the bottom face 132 of the first strap member 122 may include padding, and the bottom face 182 of the third strap member 172 may include padding to make the strap 102 more comfortable when used in the dual-shoulder configuration (FIGS. 5 and 9). Alternatively, the padding may be within or integral to the connector 104 and each strap member 122, 172.

Figure 11:
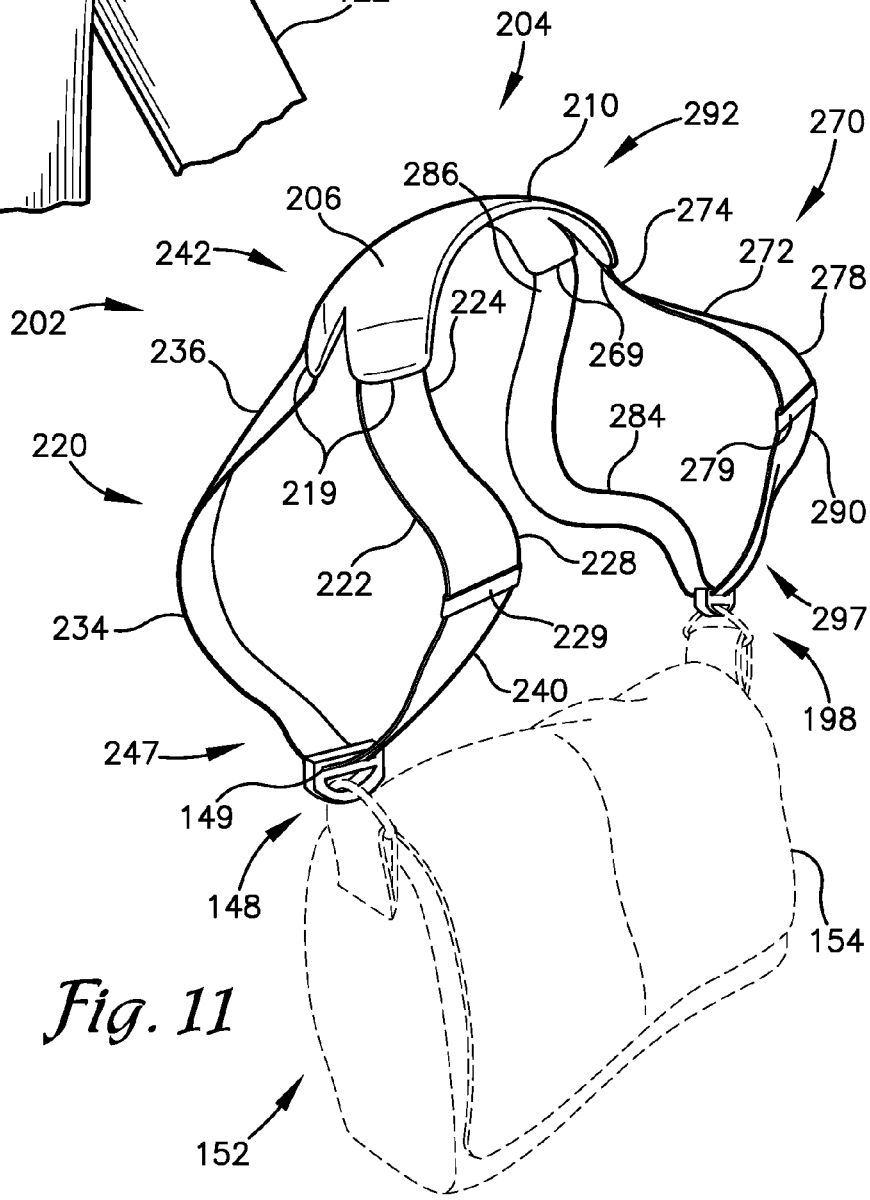
FIG. 11 is an alternative embodiment strap embodying principles of the disclosed subject matter supporting an object.

An alternative embodiment strap 202 is shown in FIG. 11, whereby the first loop assembly 220 and second loop assembly 270 are joined by a middle portion or connector 204. The strap 202 is shown supporting an object 152, such as luggage 154. The first loop assembly 220 includes a first strap member 222 and a second strap member 234, connected to a first end 206 of the connector 204 at attachment points 219. The first strap member 222 is a width of material, including a nylon strap, and extends between a first end 224 connected to the connector 204, and a second end 228 having a buckle 229. The second strap member 234 is a width of material, including a nylon strap, and extends between a first end 236 connected to the connector 204, and a second end 240. The second end 240 is threaded through the buckle 229 creating a loop 247 opposite the connector 204 in the first loop assembly 220. The first loop assembly 220 may further include a first attachment 148 for attaching the first loop assembly 220 to the object 152. The first ends 224 and 236 intersect at the attachment point 219 forming a Y-shaped connection 242 thereby allowing the first loop assembly 220 to transition into a shoulder strap in the form generally of a circle.

The second loop assembly 270 includes a third strap member 272 and a fourth strap member 284, connected to a second end 210 of the connector 204 at attachment points 269. The third strap member 272 is a width of material, including a nylon strap, and extends between a first end 274 connected to the connector 204, and a second end 278 having a buckle 279. The fourth strap member 284 is a width of material, including a nylon strap, and extends between a first end 286 connected to the connector 204, and a second end 290. The second end 290 is threaded through the buckle 279 creating a loop 297 opposite the connector 204 in the second loop assembly 270. The second loop assembly 270 may further include a second attachment 198 for attaching the second loop assembly 270 to the object 152. The first ends 274 and 286 intersect at the attachment points 269 forming a Y-shaped connection 292 thereby allowing the second loop assembly 270 to transition into a shoulder strap in the form generally of a circle.

The Y-shaped connections 242 and 292 allow the first loop assembly 220 and second loop assembly 270 to transition from a single-shoulder configuration to a dual-shoulder configuration, similar to the strap 102 above.

In an alternative embodiment, the loop assemblies 220 and 270, and the connector 204 may be provided with padding on the surface contacting the body, or integrated within, to make the strap 202 more comfortable during use.

The detailed description set-forth above is provided to aid those skilled in the art in practicing the present disclosed subject matter. However, the subject matter described and claimed herein is not to be limited in scope by the specific embodiments herein disclosed because these embodiments are intended as an illustration of several aspects of the technology. Any equivalent embodiments are intended to be within the scope of the disclosed subject matter. Indeed, various modifications of the technology in addition to those shown and described herein will become apparent from the foregoing description which does not depart from the spirit or scope of the disclosed technology. Such modifications are also intended to fall within the scope of the appended claims.

Having thus described the disclosed subject matter, what is claimed as new and desired to be secured by Letters Patent is:

1. A convertible strap for carrying an object, comprising:

a connector extending between a first end and a second end;

a first loop assembly, comprising:

a first strap member having a top face and a bottom face, and extending between a first end and a second end, wherein the first end forms an aperture;

a second strap member having a top face and a bottom face, and extending between a first end and a second end, wherein the first end forms an aperture;

a first hardware connecting the first strap member second end and second strap member second end; and wherein the bottom face of the second strap member first end overlaps the top face of the first strap member first end aligning the apertures, a fastener pivotally attaching the overlapping strap members to the connector first end, the first and second strap members thereby forming a circle with a center in which the bottom face of the first strap member and the bottom face of the second strap member face the center of the circle when the first loop assembly forms a circle;

a second loop assembly, comprising:

a third strap member having a top face and a bottom face, and extending between a first end and a second end, wherein the first end forms an aperture;

a fourth strap member having a top face and a bottom face, and extending between a first end and a second end, wherein the first end forms an aperture;

a second hardware connecting the third strap member second end and fourth strap member second end; and wherein the bottom face of the fourth strap member first end overlaps the top face of the third strap member first end aligning the apertures, a fastener pivotally attaching the overlapping strap members to the connector second end, the fourth and fifth strap members thereby forming a circle with a center in which the bottom face of the third strap member and the bottom face of the fourth strap member face the center of the circle when the second loop assembly forms a circle;

a first attachment slidably connected to the first loop assembly for attaching the first loop assembly to the object, wherein the first attachment freely slides along the first loop assembly; and a second attachment slidably connected to the second loop assembly for attaching the second loop assembly to the object, wherein the second attachment freely slides along the second loop assembly.

2. The convertible strap of claim 1, further including padding attached to the first strap member and padding attached to the second strap member.

3. The convertible strap of claim 1, wherein the connector comprises a resilient material.

4. The convertible strap of claim 1, further including padding attached to the connector.

5. A convertible strap for carrying an object, comprising:

an elongated connector extending between a first end and a second end;

a first loop assembly, comprising:

a first strap member having a top face and a bottom face, and extending between a first end and a second end, wherein the first end forms an aperture;

a second strap member having a top face and a bottom face, and extending between a first end and a second end, wherein the first end forms an aperture;

a first hardware connecting the first strap member second end and second strap member second end; and wherein the bottom face of the first strap member first end overlaps the top face of the second strap member first end aligning the apertures, a fastener pivotally attaching the overlapping strap members to the connector first end, the first and second strap members thereby forming a circle with a center in which the bottom face of the first strap member and the bottom face of the second strap member face the center of the circle.

a second loop assembly, comprising:

a third strap member having a top face and a bottom face, and extending between a first end and a second end, wherein the first end forms an aperture;

a fourth strap member having a top face and a bottom face, and extending between a first end and a second end, wherein the first end forms an aperture;

a second hardware connecting the third strap member second end and fourth strap member second end;

wherein the bottom face of the third strap member first end overlaps the top face of the fourth strap member first end aligning the apertures, a fastener pivotally attaching the overlapping strap members to the connector second end, the third and fourth strap members thereby forming a circle with a center in which the bottom face of the third strap member and the bottom face of the fourth strap member face the center of the circle;

a first attachment slidably connected to the first loop assembly for attaching the first loop assembly to the object, wherein the first attachment freely slides along the first loop assembly; and a second attachment slidably connected to the second loop assembly for attaching the second loop assembly to the object, wherein the second attachment freely slides along the second loop assembly.

6. The convertible strap of claim 5, wherein:

the first hardware is a buckle; and the second hardware is a buckle.

7. The convertible strap of claim 1, wherein:

the first hardware is a buckle; and the second hardware is a buckle.

* * * * *